US006272705B1

(12) United States Patent
Jones

(10) Patent No.: US 6,272,705 B1
(45) Date of Patent: Aug. 14, 2001

(54) BED FRAME FOR INVALIDS

(76) Inventor: Wilma Fay Jones, 18490 Purnell Rd., Lake Elsinore, CA (US) 92532-2061

( * ) Notice: Subject to any disclaimer, the term of this patent is extended or adjusted under 35 U.S.C. 154(b) by 0 days.

(21) Appl. No.: 09/616,982

(22) Filed: Jul. 14, 2000

(51) Int. Cl.[7] ..... A61G 7/057; A61G 7/047

(52) U.S. Cl. ..... 5/691; 5/191; 5/310; 5/606; 5/724

(58) Field of Search ..... 5/600, 606, 632, 5/110, 112, 191, 310, 311, 691, 690, 724, 186.1

(56) References Cited

U.S. PATENT DOCUMENTS

| | | | | |
|---|---|---|---|---|
| D. 339,188 | | 9/1993 | Rossman | D23/213 |
| 2,924,832 | * | 2/1960 | Knowles | 5/606 |
| 3,134,987 | | 6/1964 | Bertram | 5/111 |
| 3,719,962 | | 3/1973 | Burkley | 5/600 |
| 3,893,198 | | 7/1975 | Blair . | |
| 4,034,518 | * | 7/1977 | Trecker | 5/112 |
| 4,843,690 | * | 7/1989 | Iacobucci et al. | 5/606 |
| 5,462,519 | | 10/1995 | Carver . | |
| 5,815,860 | * | 10/1998 | Mitchell | 5/310 |
| 5,855,031 | | 1/1999 | Swift, Jr. | 5/655 |
| 6,006,382 | * | 12/1999 | Smith | 5/310 |

* cited by examiner

*Primary Examiner*—Alexander Grosz

(57) ABSTRACT

A bed frame for invalids for alleviating and preventing bedsores. The bed frame for invalids includes a frame. The frame includes a perimeter portion having a first side bar, a second side bar, a first end bar and a second end bar. The bars are integrally coupled together such that the perimeter portion generally has a rectangular shape. The perimeter portion comprises a plastic material. Each of a plurality of leg members is integrally coupled to and extends downwardly from one of the side bars. Each of the leg members has a free end adapted for positioning on one of the parallel support members of a first bed frame. A supporting means supports a body on the frame. The supporting means extends transversely across and is securely attached to the perimeter portion.

13 Claims, 3 Drawing Sheets

BED FRAME FOR INVALIDS

BACKGROUND OF THE INVENTION

1. Field of the Invention

The present invention relates to bed frames and more particularly pertains to a new bed frame for invalids for alleviating and preventing bedsores.

2. Description of the Prior Art

The use of bed frames is known in the prior art. More specifically, bed frames heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 3,719,962; U.S. Pat. No. 3,893,198; U.S. Pat. No. 5,462,519; U.S. Pat. No. 3,134,987; U.S. Pat. No. 5,855,031; and U.S. Des. Pat. No. 339,188.

While these devices fulfill their respective, particular objectives and requirements, the aforementioned patents do not disclose a new bed frame for invalids. The inventive device includes a frame. The frame includes a perimeter portion having a first side bar, a second side bar, a first end bar and a second end bar. The bars are integrally coupled together such that the perimeter portion generally has a rectangular shape. The perimeter portion comprises a plastic material. Each of a plurality of leg members is integrally coupled to and extends downwardly from one of the side bars. Each of the leg members has a free end adapted for positioning on one of the parallel support members of a first bed frame. A supporting means Supports a body on the frame. The supporting means extends transversely across and is securely attached to the perimeter portion.

In these respects, the bed frame for invalids according to the present invention substantially departs from the conventional concepts and designs of the prior art, and in so doing provides an apparatus primarily developed for the purpose of alleviating and preventing bedsores.

SUMMARY OF THE INVENTION

In view of the foregoing disadvantages inherent in the known types of bed frames now present in the prior art, the present invention provides a new bed frame for invalids construction wherein the same can be utilized for alleviating and preventing bedsores.

The general purpose of the present invention, which will be described subsequently in greater detail, is to provide a new bed frame for invalids apparatus and method which has many of the advantages of the bed frames mentioned heretofore and many novel features that result in a new bed frame for invalids which is not anticipated, rendered obvious, suggested, or even implied by any of the prior art bed frames, either alone or in any combination thereof.

To attain this, the present invention generally comprises a frame. The frame includes a perimeter portion having a first side bar, a second side bar, a first end bar and a second end bar. The bars are integrally coupled together such that the perimeter portion generally has a rectangular shape. The perimeter portion comprises a plastic material. Each of a plurality of leg members is integrally coupled to and extends downwardly from one of the side bars. Each of the leg members has a free end adapted for positioning on one of the parallel support members of a first bed frame. A supporting means supports a body on the frame. The supporting means extends transversely across and is securely attached to the perimeter portion.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying, Out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new bed frame for invalids apparatus and method which has many of the advantages of the bed frames mentioned heretofore and many novel features that result in a new bed frame for invalids which is not anticipated, rendered obvious, suggested, or even implied by any of the prior art bed frames, either alone or in any combination thereof.

It is another object of the present invention to provide a new bed frame for invalids which may be easily and efficiently manufactured and marketed.

It is a further object of the present invention to provide a new bed frame for invalids which is of a durable and reliable construction.

An even further object of the present invention is to provide a new bed frame for invalids which is susceptible of a low cost of manufacture with regard to both materials and labor, and which accordingly is then susceptible of low prices of sale to the consuming public, thereby making such bed frame for invalids economically available to the buying public.

Still yet another object of the present invention is to provide a new bed frame for invalids which provides in the apparatuses and methods of the prior art some of the advantages thereof, while simultaneously overcoming some of the disadvantages normally associated therewith.

Still another object of the present invention is to provide a new bed frame for invalids for alleviating and preventing bedsores.

Yet another object of the present invention is to provide a new bed frame for invalids which includes a frame. The frame includes a perimeter portion having a first side bar, a second side bar, a first end bar and a second end bar. The bars are integrally coupled together such that the perimeter portion generally has a rectangular shape. The perimeter portion comprises a plastic material. Each of a plurality of leg members is integrally coupled to and extends downwardly from one of the side bars. Each of the leg members has a free end adapted for positioning on one of the parallel support members of a first bed frame. A supporting means supports a body on the frame. The supporting means extends transversely across and is securely attached to the perimeter portion.

Still yet another object of the present invention is to provide a new bed frame for invalids that is retrofittable over an existingbed frame and has telescoping legs to accommodate mattresses already on a bed frame.

Even still another object of the present invention is to provide a new bed frame for invalids that has a meshed support surface for allowing air to circulate around a user.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
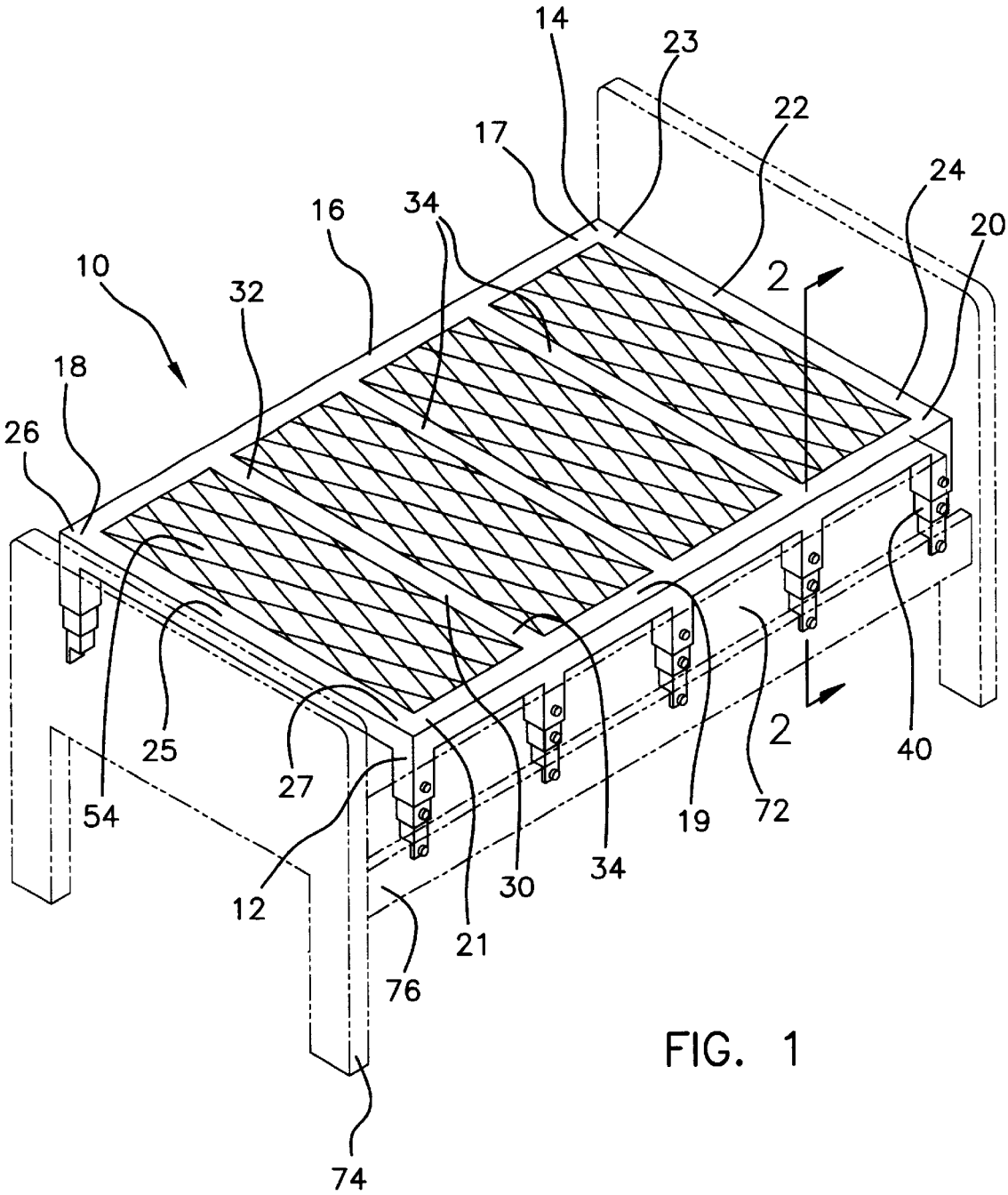
FIG. 1 is a schematic perspective view of a new bed frame for invalids according to the present invention.

With reference now to the drawings, and in particular to FIGS. 1 through 5 thereof, a new bed frame for invalids embodying the principles and concepts of the present invention and generally designated by the reference numeral 10 will be described.

As best illustrated in FIGS. 1 through 5, the bed frame for invalids 10 generally comprises a frame 12, the frame 12 comprises a perimeter portion 14, a plurality of support bars 30 and a plurality of leg members 40.

The perimeter portion 14 has a first side bar 16, a second side bar 19, a first end bar 22 and a second end bar 25. Each of the bars is generally hollow. A first end 17 of the first side bar 16 is integrally coupled to a first end 23 of the first end bar 22. A second end 18 of the first side bar 16 is integrally coupled to a first end 26 of the second end bar 25. A first end 20 of the second side bar 19 is integrally coupled to a second end 24 of the first end bar 22. A second end 21 of the second side bar 19 is integrally coupled to a second end 27 of the second end bar 25. The perimeter portion 14 generally has a rectangular shape.

The plurality of support bars 30 each has a first end 32 and a second end 34. Each of the first ends 32 is integrally coupled to the first side bar 16 and each of the second ends 34 of the support bars 30 is integrally coupled to the second side bar 19. The support bars 30 are orientated generally perpendicular to the side bars 16, 19.

Figure 2:
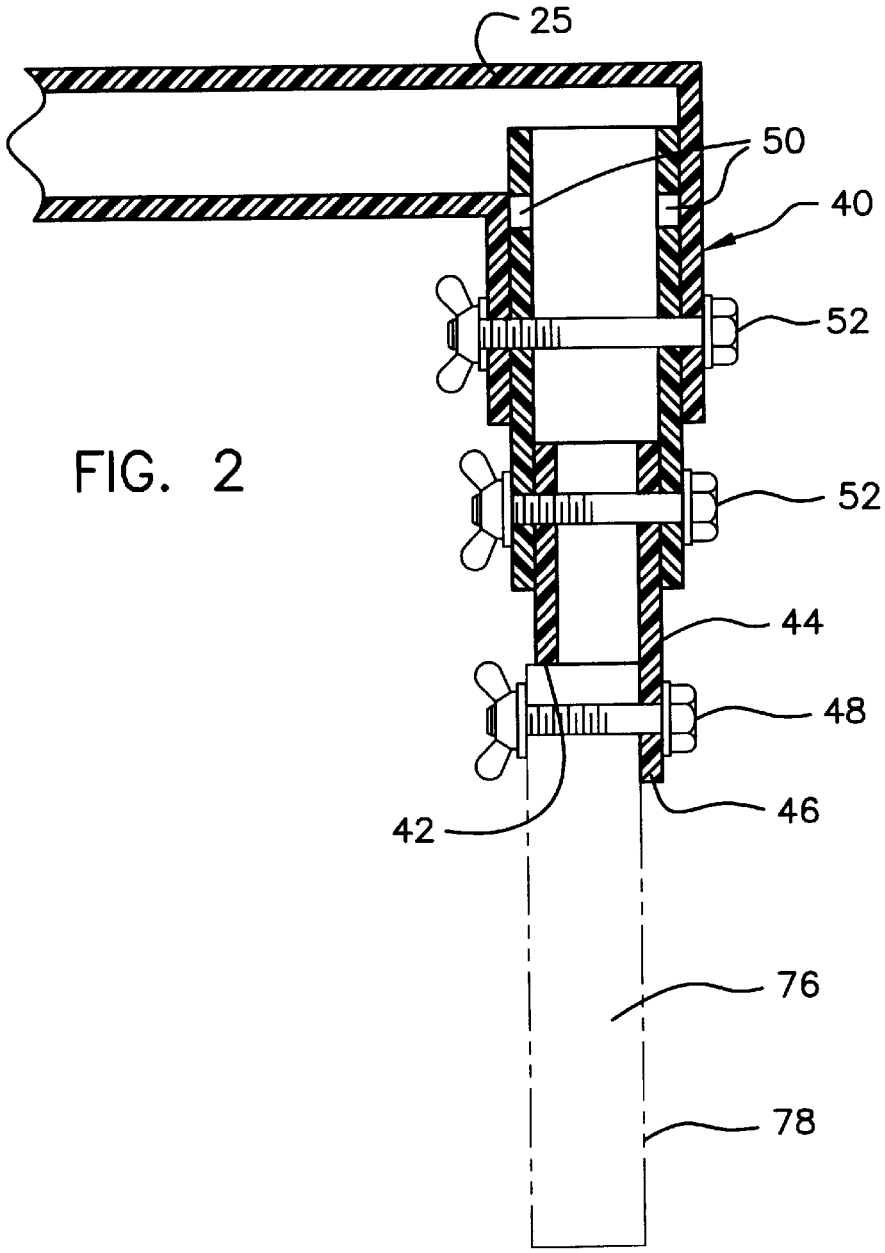
FIG. 2 is a schematic cross-sectional view taken along line 2—2 of the present invention.
Figure 3:
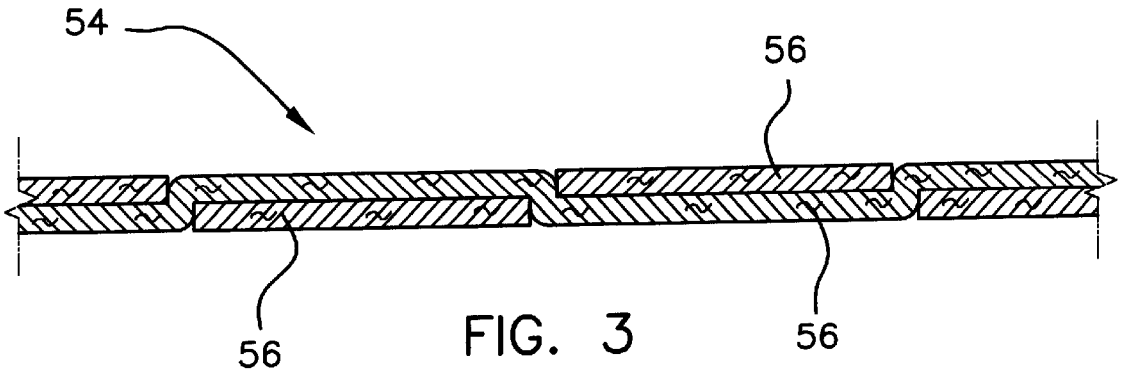
FIG. 3 is a schematic side view of the supporting means of the present invention.
Figure 4:
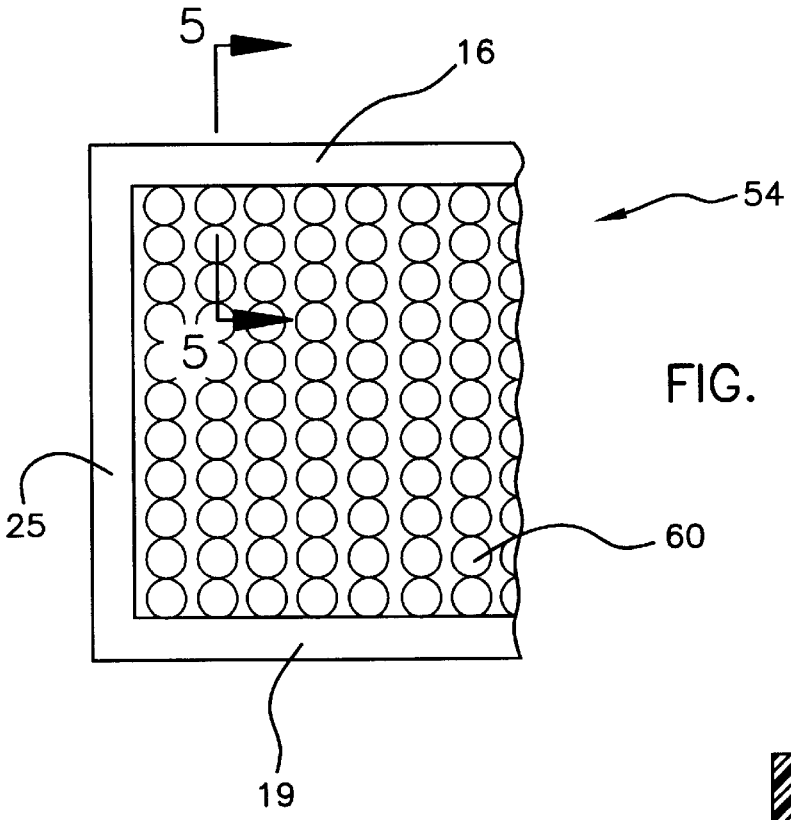
FIG. 4 is a schematic plan view of the second embodiment of the present invention.
Figure 5:
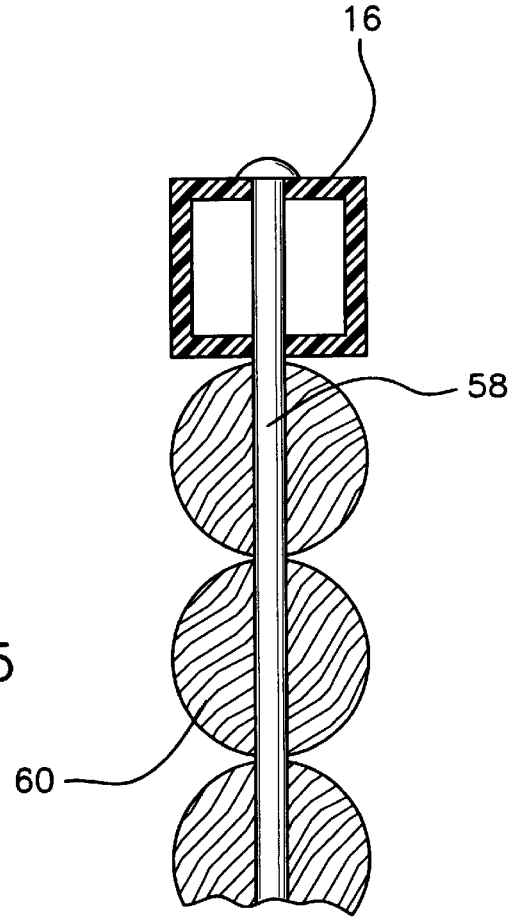
FIG. 5 is a schematic cross-sectional view taken along line 5—5 of the present invention.

Each of the plurality of leg members 40 is integrally coupled to and extends downwardly from one of the side bars 16, 19. Each of the leg members 40 is generally hollow. Each of the leg members 40 has a free end 42. Each of the free ends 42 has an outside edge 44 having a flange 46 extending downwardly therefrom. The flanges 46 may be abutted against an outside surface 78 of one of the parallel support members 76 of a first bed frame 74. Bolts 48 may be extended through the flange 46 and into the first bed frame 74 for additional support. Each of the leg members 40 is a telescoping leg member and is comprised of a plurality of leg portions. Each of the leg portions has a plurality of opposed openings 50 therein. A plurality of pins 52 is extendable through the opposed openings 50 for selectively supporting the leg members 40 in an extended position as shown in FIG. 2. Ideally there are five leg members 40 attached to each side bar 16, 19 of the device 10.

Preferably, the perimeter portion 14, the support bars 30 and the leg members 40 each comprise a plastic material.

A supporting means 54 for supporting a body on the frame 12 comprises a plurality of meshed, or interwoven, strips 56. Each of the strips 56 has a first end and second end each securely attached to the perimeter portion 14. Each of the strips 56 generally extends transversely across the perimeter portion 14. Each of the strips 56 preferably comprises a plastic material. Each of the strips 56 is in an angular relationship with the first 16 and second 19 side bars. The angular relationship is generally between 30 degrees and 60 degrees.

In a second embodiment, the supporting means 54 consists of a plurality of rods 58. Each of the rods 58 extends across the perimeter portion 14 and is securely attached to each of the first 16 and second 19 side bars. Each of a plurality of spheres 60 has a rod 58 extending therethrough such that each of the spheres 60 is rotatably positioned on one of the rods 58. The rods 58 and spheres 60 are positioned such that the spheres 60 on each rod 58 are generally abutting each other, and the spheres 60 on a first rod are within one inch of the spheres on a rod adjacent to the first rod. The spheres 60 are preferably made from wood or plastic.

In use, the flange 46 on the leg members 40 allows the device to be placed on the first bed frame 74 over the mattress 72 so that the mattress 72 does not have to be moved. The legs 40 are telescoping to accommodate the different sized mattresses 72. The user lies on the device 10. The interwoven strips 56, or the spheres 60, allow air to move upwardly through-the supporting means 54 and relieves pressure on the user. This prevents bedsores (decubitus ulcers) and the like.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A bed frame device for supporting the whole body of an invalid and for resisting bed sores, said device being removably mountable to a first bed frame, said first bed frame having a pair of parallel support members, said device comprising:

a frame, said frame comprising;

a perimeter portion having a first side bar, a second side bar, said first and second bars being approximately the same length as said parallel support members, a first end bar and a second end bar, said bars being integrally coupled together such that said perimeter portion generally has a rectangular shape, said perimeter portion comprising a plastic material;

a plurality of leg members, each of said leg members being integrally coupled to and extending downwardly from one of said side bars, each of said leg members having a free end adapted for positioning and securely and removably attaching on one of said parallel support members, said leg member being vertically adjustable to thereby permit the vertical adjustment of the side bars relative to the support members;

a supporting means for supporting a body on said frame, said supporting means extending transversely across and being securely attached to said perimeter portion, said support means permitting air to flow therethrough, thereby resisting the formation of bedsores.

2. The bed frame device as in claim 1, further comprising:

a plurality of support bars, each of said support bars having a first end and a second end, each of said first ends being integrally coupled to said first side bar and each of said second ends of said support bars being integrally coupled to said second side bar, said support bars being orientated generally perpendicular to said side bars.

3. The bed frame device as in claim 1, wherein each of said leg members comprises:

each of said free ends having an outside edge having a flange extending downwardly therefrom, wherein said flanges may be abutted against an outside surface of one of said parallel support members.

4. The bed frame device as in claim 1, wherein each of said leg members comprises:

each of said leg members being telescoping leg members and being comprised of a plurality of leg portions, each of said leg portions having a plurality of opposed openings therein, a plurality of pins being extendable through said opposed openings for selectively supporting said leg members in an extended position.

5. The bed frame device as in claim 1, wherein said supporting means comprises:

a plurality of rods, each of said rods extending across said perimeter portion and being securely attached to each of said first and second side bars;

a plurality of spheres, each of said spheres having a rod extending therethrough such that each of said spheres is rotatably positioned on one of said rods; and wherein said rods and spheres are positioned such that said spheres on each rod are generally abutting each other and wherein said spheres on a first rod are within one inch of the spheres on a rod adjacent to said first rod.

6. The bed frame device as in claim 1, wherein said supporting means comprises:

a plurality of meshed strips, each of said strips having a first end and second end each securely attached to said perimeter portion, each of said strips comprising a plastic material, each of said strips being in an angular relationship with said first and second side bars, said angular relationship being generally between 30 degrees and 60 degrees.

7. A bed frame device for invalids for resisting bed sores, said device being removably mountable to a first bed frame, said first bed frame having a pair of parallel support members, said device comprising:

a frame, said frame comprising;

a perimeter portion having a first side bar, a second side bar, a first end bar and a second end bar, a first end of said first side bar being integrally coupled to a first end of said first end bar, a second end of said first side bar being integrally coupled to a first end of said second end bar, a first end of said second side bar being integrally coupled to a second end of said first end bar, a second end of said second side bar being integrally coupled to a second end of said second end bar, said perimeter portion generally having a rectangular shape;

a plurality of support bars, each of said support bars having a first end and a second end, each of said first ends being integrally coupled to said first side bar and each of said second ends of said support bars being integrally coupled to said second side bar, said support bars being orientated generally perpendicular to said side bars;

a plurality of leg members, each of said leg members being integrally coupled to and extending downwardly from one of said side bars, each of said leg members having a free end, each of said free ends having an outside edge having a flange extending downwardly therefrom, wherein said flanges may be abutted against an outside surface of one of said parallel support members, each of said leg members being telescoping leg members and being comprised of a plurality of leg portions, each of said leg portions having a plurality of opposed openings therein, a plurality of pins being extendable through said opposed openings for selectively supporting said leg members in an extended position;

said perimeter portion, said support bars and said leg members each comprising a plastic material; and a supporting means for supporting a body on said frame, said supporting means comprising a plurality of meshed strips, each of said strips having a first end and second end each securely attached to said perimeter portion, each of said strips extending transversely across said perimeter portion, each of said strips comprising a plastic material, each of said strips being in an angular relationship with said first and second side bars, said angular relationship being generally between 30 degrees and 60 degrees.

8. A bed frame device for supporting the whole body of an invalid and for resisting bed sores, said device being removably mountable to a first bed frame, said first bed frame having a pair of parallel support members, said device comprising: a frame comprising;

a perimeter portion having a first side bar, a second side bar, said first and second bars being approximately the same length as said parallel support members, a first end bar and a second end bar, said bars being integrally coupled together such that said perimeter portion generally has a rectangular shape;

a plurality of leg members, each of said leg members being integrally coupled to and extending downwardly from one of said side bars, each of said leg members having a free end adapted for positioning and securely and removably attaching on one of said parallel support members, said leg member being vertically adjustable to thereby permit the vertical adjustment of the side bars relative to the support members;

a supporting means for supporting a body on said frame, said supporting means extending transversely across and being securely attached to said perimeter portion, said support means permitting air to flow therethrough, thereby resisting the formation of bedsores.

9. The bed frame device as in claim 8, further comprising a plurality of support bars, each of said support bars having a first end and a second end, each of said first ends being integrally coupled to said first side bar and each of said second ends of said support bars being integrally coupled to said second side bar, said support bars being orientated generally perpendicular to said side bars.

10. The bed frame device as in claim 8, wherein each of said free ends of said leg members has an outside edge having a flange extending downwardly therefrom, wherein said flanges may be abutted against an outside surface of one of said parallel support members.

11. The bed frame device as in claim 8, wherein each of said leg members is a telescoping leg member and is comprised of a plurality of leg portions, each of said leg portions having a plurality of opposed openings therein, a plurality of pins being extendable through said opposed openings for selectively supporting said leg members in an extended position.

12. The bed frame device as in claim 8, wherein said supporting means comprises:

a plurality of rods, each of said rods extending across said perimeter portion and being securely attached to each of said first and second side bars;

a plurality of spheres, each of said spheres having a rod extending therethrough such that each of said spheres is rotatably positioned on one of said rods; and wherein said rods and spheres are positioned such that said spheres on each rod are generally abutting each other.

13. The bed frame device as in claim 8, wherein said supporting means comprises a plurality of meshed strips, each of said strips having a first end and second end each securely attached to said perimeter portion, each of said strips comprising a plastic material, each of said strips being in an angular relationship with said first and second side bars, said angular relationship being generally between 30 degrees and 60 degrees.

* * * * *